United States Patent [19]

McDougall

[11] Patent Number: 4,912,881

[45] Date of Patent: Apr. 3, 1990

[54] MULTIPLE ANGLE DRESSING DEVICE FOR TOOLS AND STOCK

[76] Inventor: Philip N. McDougall, 509 - 825 Granville St., Vancouver, B.C., V6Z 1K9, Canada

[21] Appl. No.: 208,595

[22] Filed: Jun. 20, 1988

[51] Int. Cl.[4] ..... B24B 7/02

[52] U.S. Cl. ..... 51/157; 51/240 A; 51/214

[58] Field of Search ..... 51/157, 158, 156, 159, 51/217 A, 218 A, 224, 231, 240 A, 240 R, 122, 214, 205 WG, 238 R, 238 T, 149, 173; 29/80

[56] References Cited

U.S. PATENT DOCUMENTS

| | | | |
|---|---|---|---|
| 238,366 | 3/1881 | Doane | 51/122 |
| 584,626 | 6/1877 | Curley | 51/159 |
| 975,785 | 11/1910 | Neumuth | 51/239 |
| 1,411,713 | 4/1922 | Downing | 51/157 |
| 1,540,078 | 6/1925 | Long | 51/158 |
| 1,675,981 | 7/1928 | Lees | 51/157 |

FOREIGN PATENT DOCUMENTS

| | | | |
|---|---|---|---|
| 2224196 | 11/1973 | Fed. Rep. of Germany | 51/218 A |

*Primary Examiner*—Robert Rose

[57] ABSTRACT

This invention provides a device that assists in the manual abrading and dressing at a selected angle of the edges of tools and other materials. The device can be mounted on a workbench and comprises a frame in which is mounted an abrasive means such a file, rasp or honing stone. A supporting platform, on which is mounted a pushing block and a handle, is slidably mounted in the frame. The object to be dressed is placed on the supporting platform, both of which can then be moved back and forth with one hand by the user, while the other hand pushes the object against the abrasive surface. The angle of the supporting platform in relation to the abrasive means can be made adjustable by means of a portion of the supporting platform comprising an angle-control supporting portion that is pivotally attached along one side of a base portion of the platform, the pivotal attachment being on the side of the platform adjacent to the abrasive means. A slotted flange, calibrated in degrees, is mounted perpendicular to the base portion in a position that enables a bolt or nut to lock the supporting platform at the selected angle.

11 Claims, 1 Drawing Sheet

MULTIPLE ANGLE DRESSING DEVICE FOR TOOLS AND STOCK

FIELD OF THE INVENTION

The present invention relates to implement sharpening devices and in particular discloses a device that assists in the manual abrading and dressing at a selected angle of the edges of tools and other materials.

DESCRIPTION OF THE PRIOR TECHNOLOGY

Numerous different devices exist for the purpose of sharpening tools and instruments. Simple carborundum stones are used to sharpen the edges of knives. A cutting edge on a tool can be formed or sharpened by pressing the tool at an appropriate angle against a rotating grindstone. A file or rasp can be used to sharpen concave cutting edges, such as are found on a chain saw. It is common that the sharpening of a edge is done in a freehand manner, without guides, generally resulting in an irregular angle of dressing and an unsatisfactory edge. There are holding devices for files in which the holder has guiding flanges, as for example on a ski edge sharpener.

None of the prior technology discloses the arrangement of features that comprise this invention.

SUMMARY OF THE PRESENT INVENTION

This invention provides a device that can be mounted on a workbench and that assists in the orientation and controlled movement of an object against an abrasive surface solidly mounted in the device. The device is designed primarily to assist in the dressing of edges of tools, stock, and other objects. The edges can be smoothed or sharpened depending on the angle at which the edge is moved against the abrasive surface.

The device is comprised of a frame in which is mounted an abrasive means such a file, rasp or honing stone. A supporting platform is slidably mounted in the frame. The object to be dressed is placed on the supporting platform, both of which can then be moved back and forth with one hand by the user, while the other hand pushes the object against the abrasive surface. A handle is attached to the supporting platform to enable the user to better hold and move the platform. A flange or block is mounted on the supporting platform to transmit the pushing force from the handle to the object that is placed on the supporting handle. The supporting platform can be slidably mounted in the frame by means of a dovetail joint. For example, the frame could be constructed with a dovetail groove and the base of the supporting platform could be correspondingly shaped as a dovetail projection. If the tolerance of fit of the joint is fine, the supporting platform will support an object to be dressed at a constant angle in relation to the abrasive means.

The angle of the supporting platform in relation to the abrasive means can be made adjustable by means of a portion of the supporting platform comprising an angle-control supporting portion that is pivotally attached along one side to a base portion of the platform, the base portion being slidably mounted in the frame, the pivotal attachment being on the side of the platform adjacent to the abrasive means. A flange perpendicular to the supporting platform and mounted on the base portion provides an area that can be gripped by a wing nut threaded onto a projecting bolt attached to the end of the angle-control supporting portion. It would be useful to have the projecting bolt received in a circular section curved slot in the flange, in order to confine the movement of the angle-control supporting portion to the desired range of pivoting. The flange could be calibrated with markings from 0 to 90 degrees or more.

Long tools or stock materials can be accommodated by the device at the selected angle by means of having a second adjustable angle-control supporting portion pivotally attached to the base portion at a distance from the first angle-control supporting portion.

The angle-control supporting structures could be made to be detachable from, and adjustable in relation to the rest of the supporting platform by means of lateral dovetail joints and locking bolts or nuts. This will enable the angle-control supporting structures to be moved away from the abrasive means, allowing the device to accommodate thick tools and stock, or to be removed altogether, allowing the use of the device without any effective angle with regard to the abrasive means other than the angle built into the frame. In the preferred embodiment, this angle would be perpendicular.

Another enhancement to this device would be to have a pivot pole detachably mounted in the frame. This pole would assist the user in dressing a curved edge on an object by providing a fulcrum around which the object can be rotated (or otherwise moved in the case of irregular curves) in the process of pressing the curved edge against the abrasive surface.

The abrasive means can optionally be detachably mounted in the frame, allowing the abrasive surface to be replaced when dull or worn out, and allowing different kinds of abrasive surface to used. As a further option, the position of the abrasive surface can by made adjustable by means of bolts projecting from the back of the abrasive means and received in slots on the frame and held in a selected position by nuts that grip the frame as they are tightened onto the bolts. Alternatively, threaded bolts could be screwed through slots in the back of the frame and into correspondingly tapped holes in the file or other abrasive means. This adjustment will enable the device to accommodate a variety of sizes of objects to be dressed.

The frame and supporting platform can be made of tooled or molded plastic, cast, stamped or tooled metal, tooled wood, or any other suitable material.

DETAILED DESCRIPTION

Figure 1:
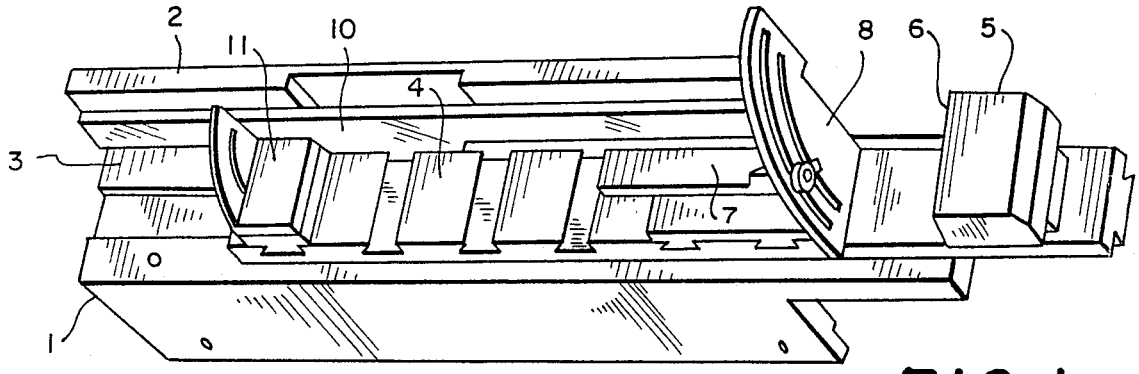
FIG. 1 is a perspective showing a preferred embodiment of this invention.

Referring to FIG. 1, the frame 1 is shown with its back 2 and it bed 3. The sliding platform 4 has a handle 5 comprising a pushing block 6. The angle-control supporting portion 7 is adjusted in accordance with the calibrations on flange 8, to set the angle at which the object to be dressed will meet the abrasive means 10. The second angle-control supporting portion 11 assists in the support of a long object to be dressed.

Figure 2:
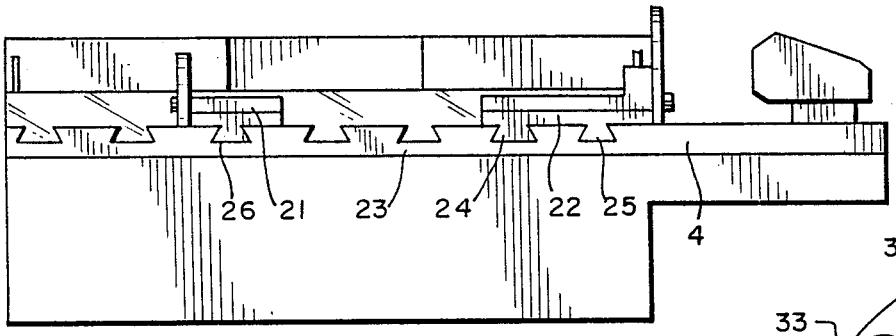
FIG. 2 is a front view of the device of FIG. 1.

Referring to FIG. 2, the base portions 22 and 21 to which the angle-control supporting portions 7 and 11 are respectively attached are themselves laterally adjustable and detachably mounted in the main part 23 of the sliding platform 4 by means of dovetail joints 24, 25 add 26.

Figure 3:
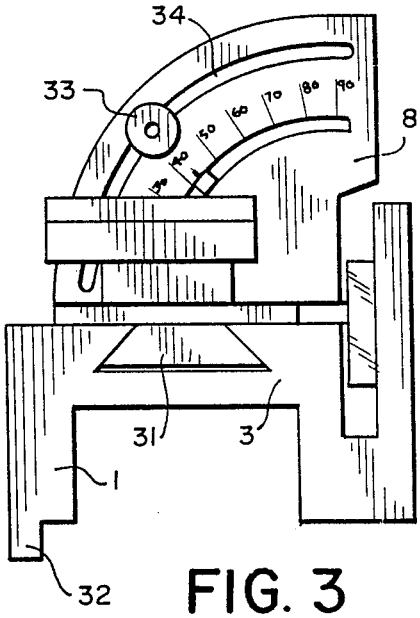
FIG. 3 is an end view showing the device of FIG. 1.

Referring to FIG. 3, the sliding platform is mounted within the bed 3 of the frame 1 by means of a dovetail joint 31. The frame has a lower flange 32 which assists in its secure placement on a workbench. The calibrations on flange 8 are used in selecting the angle for the angle-control supporting portions, and the locknut 33 is tightened at the appropriate position on the pivot slot 34.

Figure 4:
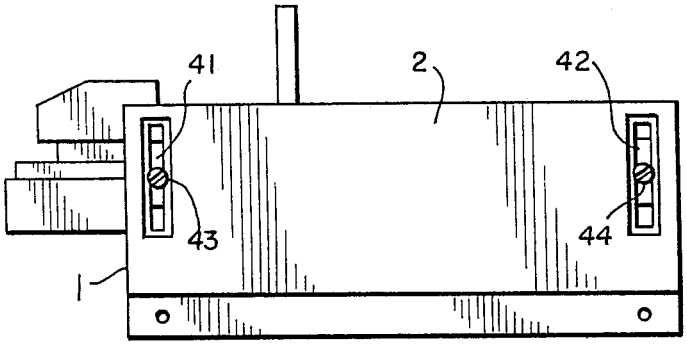
FIG. 4 is a back view showing the device of FIG. 1.

Referring to FIG. 4, the back 2 of the frame 1 has slots 41 and 42 through which bolts 43 and 44 can be tightened into the abrasive means to hold it in the desired position.

Figure 5:
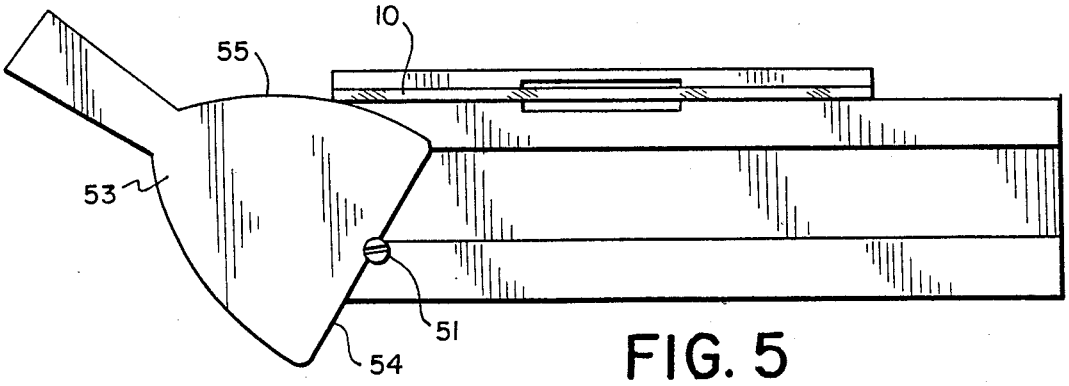
FIG. 5 is a perspective showing the use of the fulcrum pole on the device of FIG. 1.

Referring to FIG. 5, the fulcrum pole 51 is shown extended. The sliding platform has been removed from the device, allowing the curved side edge 52 of the drywaller's plaster knife 53 to be moved against the abrasive means 10 as the user rotates the straight edge 54 of the knife 53 about the fulcrum pole 51.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. A device adapted to dress tools, stock, and other objects, comprising:

(a) a frame having an abrasive means detachably mounted therein;

(b) a supporting platform slidably mounted therein, adapted to support an object to be dressed at a constant angle in relation to the abrasive means;

(c) a pushing member attached to the said slidable platform, comprising a handle adapted to enable the user to push the member against the object to be dressed and thereby slide the object supported by the platform along the frame in contact with the abrasive means;

in which the position of the abrasive means in the frame is adjustable by means of at least one projecting member on the back of the abrasive means, received in a slot on the frame and held in a selected position by gripping means.

2. The device of claim 1 above, in which the angle of the said supporting platform in relation to the abrasive means is adjustable by means of the platform comprising an angle-control supporting portion that is pivotally attached to a base portion, the pivotal attachment being on a side of the platform adjacent to the abrasive means.

3. The device of claim 2 above, in which the platform comprises first and second angle-control supporting portions, each pivotally attached along a common axis to a respective base portion.

4. The device of claim 2 above, in which the base portion, to which the angle-control supporting portion is pivotally attached, is laterally adjustable and detachably mounted in a main portion of the said slidably mounted supporting platform.

5. The device of claim 2 above, in which the angle of the supporting platform is adjusted and set by means of a gripping member adapted to hold the supporting portion at a selected position on a flange perpendicular to and mounted on the base portion.

6. The device of claim 5 above, in which the flange is calibrated and has a circular section curved slot adapted to receive a projecting member attached to the end of the supporting portion, the circular section curved slot having its center of radius at the pivotal attachment, the gripping member forming a detachable connection between the projecting member and the flange.

7. The device of claim 1 above, in which the frame is equipped with a fulcrom pole adapted to assist in the positioning and movement of a curved object to be dressed in the device.

8. The device of claim 1 above, in which the abrasive means is a file.

9. The device of claim 1 above, in which the supporting platform is slidably mounted in the frame by means of a dovetail joint.

10. The device of claim 1 above, in which the frame is provided with holes by which the frame can be mounted onto a workbench.

11. The device of claim 6 above, in which;

(a) the platform comprises first and second angle-control supporting portions, each pivotally attached along a common axis to a respective base portion;

(b) the base portion, to which the first angle-control supporting portion is pivotally attached, is laterally adjustable and detachably mounted in a main portion of the said slidably mounted supporting platform;

(c) the frame is equipped with a fulcrum pole adapted to assist in the positioning and movement of a curved object to be dressed in the device;

(d) the abrasive means is a file;

(e) the supporting platform is slidably mounted in the frame by means of a dovetail joint;

(f) the frame is provided with holes by which the frame can be mounted onto a workbench.

* * * * *